US006325349B1

(12) United States Patent
Breaux

(10) Patent No.: US 6,325,349 B1
(45) Date of Patent: Dec. 4, 2001

(54) SELF-LEVELING WINDOW BRACKET

(76) Inventor: Gaither Breaux, 5025 1/2 East Rd., Baytown, TX (US) 77521

( * ) Notice: Subject to any disclaimer, the term of this patent is extended or adjusted under 35 U.S.C. 154(b) by 0 days.

(21) Appl. No.: 09/357,581

(22) Filed: Jul. 20, 1999

(51) Int. Cl.[7] ..... A47H 1/10

(52) U.S. Cl. ..... 248/263; 248/262; 248/264

(58) Field of Search ..... 248/263, 262, 248/261, 251, 252, 254, 255, 256, 257, 258, 259, 260, 264, 265, 266, 267, 268, 269, 270, 271, 272, 273; 403/231; 160/123, 330

(56) References Cited

U.S. PATENT DOCUMENTS

| | | | | |
|---|---|---|---|---|
| 230,438 | * | 7/1880 | Porter | 403/231 |
| 722,387 | * | 3/1903 | Scott | 248/254 |
| 915,598 | * | 3/1909 | Hess, Jr. | 248/258 |
| 1,141,210 | * | 6/1915 | Pirson | 403/231 |
| 1,380,518 | * | 6/1921 | Bellig | 403/219 |
| 1,461,855 | | 7/1923 | Kroesser . | |
| 1,497,523 | | 6/1924 | Lundberg . | |
| 1,543,109 | | 6/1925 | Kass . | |
| 1,752,743 | * | 4/1930 | Kall | 248/255 |
| 1,820,205 | * | 8/1931 | Wilson | 403/231 |
| 1,901,796 | * | 3/1933 | Bell | 248/255 |
| 2,508,737 | | 5/1950 | Zeto . | |
| 2,703,693 | | 3/1955 | Cropanese . | |
| 2,706,100 | * | 4/1955 | Thomason | 248/255 |
| 2,770,437 | * | 11/1956 | Pasch | 248/262 |
| 2,848,184 | | 8/1958 | Kennedy . | |
| 2,899,166 | | 8/1959 | Pigliavento . | |
| 3,049,327 | * | 8/1962 | Caudell | 248/220.1 |
| 3,889,912 | * | 6/1975 | Ray | 248/255 |
| 4,167,261 | * | 9/1979 | Bartels | 248/270 |
| 4,229,915 | * | 10/1980 | Snow et al. | 403/219 |
| 4,466,591 | * | 8/1984 | Alonzo | 248/217.1 |
| 4,684,095 | * | 8/1987 | Athey | 248/255 |
| 5,193,775 | * | 3/1993 | Wagnon | 248/262 |
| 5,577,700 | * | 11/1996 | Williams, Jr. | 248/261 |

* cited by examiner

*Primary Examiner*—Anita King
*Assistant Examiner*—Gwendolyn Baxter
(74) *Attorney, Agent, or Firm*—Daniel N. Lundeen; Lundeen & Arismendi L.L.P.

(57) ABSTRACT

A self-leveling window support bracket for supporting window coverings within and/or over a window casing. The window support bracket comprises an L-shaped face plate, with a vertical and a horizontal section, which engages the exterior face of the window casing. Vertical and horizontal ears extend perpendicularly from the vertical and horizontal sections of the face plate. The ears are attached to the interior face of the window casing such that they are self-leveling. At least one curtain mounting projection is mounted on the face plate for supporting window coverings.

11 Claims, 5 Drawing Sheets

SELF-LEVELING WINDOW BRACKET

FIELD OF THE INVENTION

The present invention relates to a new and improved window support bracket. More specifically, the present invention relates to a self-plumbing, self-leveling window support bracket particularly useful for supporting drapery rods.

BACKGROUND OF THE INVENTION

Window support brackets are used to support drapery rods, curtain rods, venetian blinds, mini-blinds, valances, and numerous other protective or ornamental window coverings. Support brackets are typically mounted on the opposite upper corners of the window casing or window frame, making leveling of the support brackets difficult.

Generally speaking, several types of window support brackets have been developed to support drapery rods, curtain rods, and other window coverings. For example, U.S. Pat. No. 2,508,737 to Zeto (the '737 reference), U.S. Pat. No. 2,703,693 to Cropanese (the '693 reference), and U.S. Pat. No. 2,899,166 to Pigliavento (the '166 reference) all disclose window support brackets affixed to the interior upper corners of the window casing. The '737, '693, and '166 references all disclose support brackets affixed only to the vertical interior walls of the window casing. The support brackets do not interact with the upper interior surface of the window casing (which is normally level). Thus, the leveling of the support brackets of references '737, '693, and '166 is solely dependent upon the user providing proper vertical placement on the interior side of the window casing.

U.S. Pat. No. 1,461,855 to Kroesser (the '855 reference) and U.S. Pat. No. 2,848,184 to Kennedy (the '184 reference) both disclose window support brackets affixed to the exterior of window frames. The '855 reference discloses a curtain rod support that employs perpendicular arms that fit on an outside corner of a window frame, while the '184 reference discloses a pair of curtain fixtures which fit onto outside portions of a window frame. Both the '855 reference and the '184 reference are dependent upon a window frame of appropriate size to enable the support bracket to be affixed thereto.

U.S. Pat. No. 1,497,523 to Lundberg (the '523 reference) and U.S. Pat. No. 1,543,109 to Kass (the '109 reference) both disclose window support brackets that can be affixed to the exterior face of the window casing or the window frame. The '523 reference discloses a drapery support device that employs a pair of brackets, each of which supports two drapery rods. The support device has a flat face which is secured to the front face of the window casing or window frame. The '109 reference discloses a support bracket for curtain rods which has two right-angled portions that are attached to either inner side portions of a window casing or to the face of the window casing or frame. Neither the '523 reference nor the '109 reference interacts with the upper interior surface of the window casing; thus, leveling of the brackets is solely dependent upon the proper vertical placement of the support brackets along the window casing.

Therefore, there is a need for a new and improved window support bracket to overcome the restrictions and limitations of the above mentioned prior window support brackets. To begin, there is a need for a window support bracket that is self-plumbing and self-leveling. A bracket that interacts with both the side interior surface and the upper interior surface (which is normally level) will automatically be self-plumbing and self-leveling. Further, there is a need for a window support bracket that can be affixed to either a window casing or a window frame. A support bracket that is affixed to the interior window casing can be used regardless of whether a window frame exists.

Additionally, there is a need to provide a window support bracket which can accommodate different sized and shaped window coverings. Further, there is a need to provide a window support bracket with variable positioning of the window coverings.

There is also a need to provide a window support bracket that can accommodate venetian blind mounting boxes without removal or destruction of the window support bracket. Alternatively, there is a need for a window support bracket that provides integral support for venetian blinds, while still providing support for curtain rods, drapery rods, and other window coverings.

There is also a need to provide a window support bracket that is easily manufactured. Many prior window brackets utilize hinged connections, or intricate design structure thus necessitating complex manufacturing processes. Therefore it is desirable to provide a window support bracket with a simple design suitable for die stamping or injection molding.

SUMMARY OF THE INVENTION

The present invention provides a new and improved window support bracket for supporting window coverings within a window casing. The typical window casing has an exterior face comprising a top section and left and right sections depending from either end of the top section. The typical window casing also has an interior face comprising top, left and right sections substantially at right angles to the respective top, left and right sections of the exterior face. The window support bracket of the present invention first comprises an L-shaped face plate which engages the exterior face of the window casing. The L-shaped face plate comprises a vertical section and a horizontal section. Both the vertical section and the horizontal section additionally comprise an exterior edge and a vertical or horizontal joint. Vertical and horizontal ears extend perpendicularly from the vertical and horizontal joints of the vertical and horizontal sections. The ears are for attachment to the interior face of the window casing. At least one curtain mounting projection is mounted on the face plate.

The present invention also discloses a method of supporting window coverings within a window casing using the aforementioned support brackets. One step is to position the support brackets within the window casing such that the vertical ears are in contact with the interior side sections of the window casing. Another step is positioning the support brackets along the side sections of the window casing with the horizontal ears in contact with the interior top section of the interior face of the window casing. The horizontal ears are then affixed to the interior side sections of the window casing and the vertical ears are affixed to the interior top section of the window casing. Finally, the window coverings are mounted to the mounting projections.

DETAILED DESCRIPTION OF THE PREFERRED EMBODIMENT

In the following detailed description of the preferred embodiment of the window support bracket of the present invention, the invention is described for use in supporting drapery rods. However, the present invention is not restricted to such use. Those skilled in the art will recognize that the present invention is also used to advantage for supporting curtain rods, venetian blinds, mini-blinds, valances, or numerous other protective and ornamental window coverings. For this reason, reference will be made throughout this application to the "window coverings" to be supported by the present invention.

Figure 1:
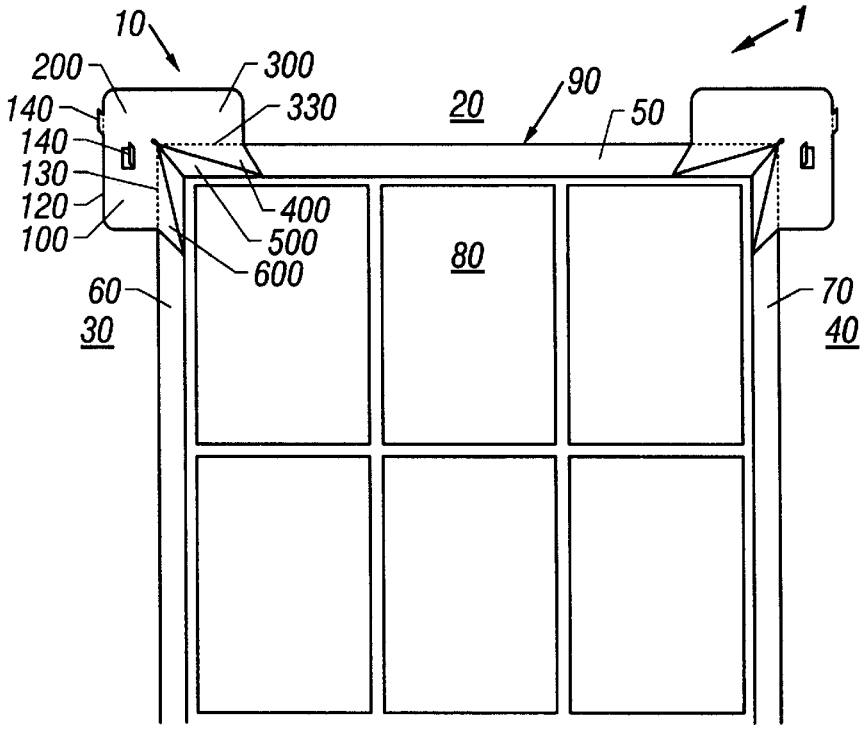
FIG. 1 is a perspective view of a preferred embodiment of the window support bracket's mounted within a window casing.
Figure 2:
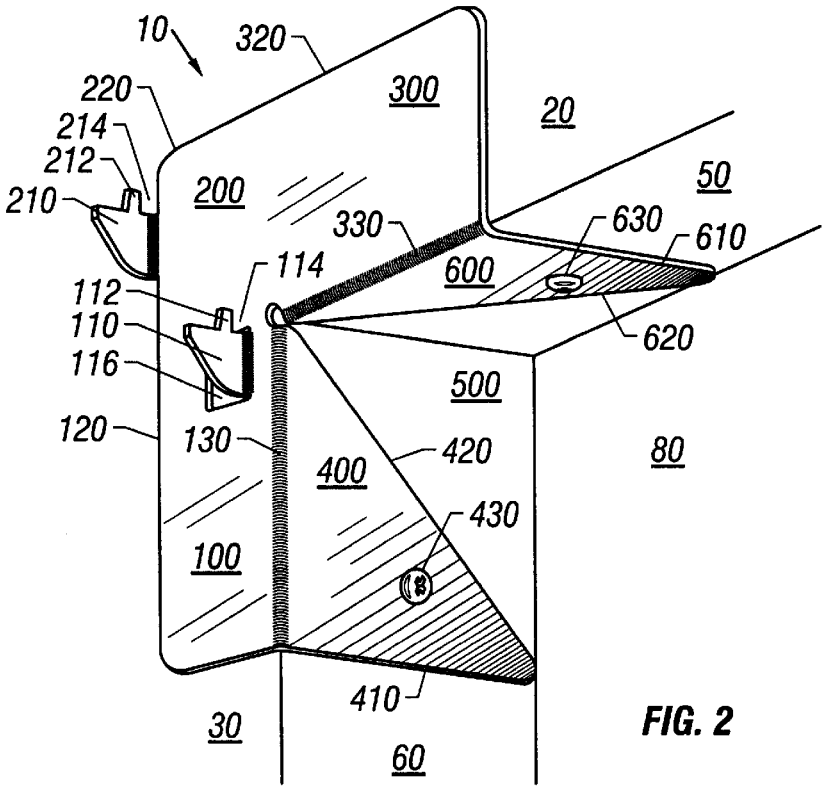
FIG. 2 is a detailed perspective view of a preferred embodiment of the window support bracket mounted within a window casing.
Figure 3:
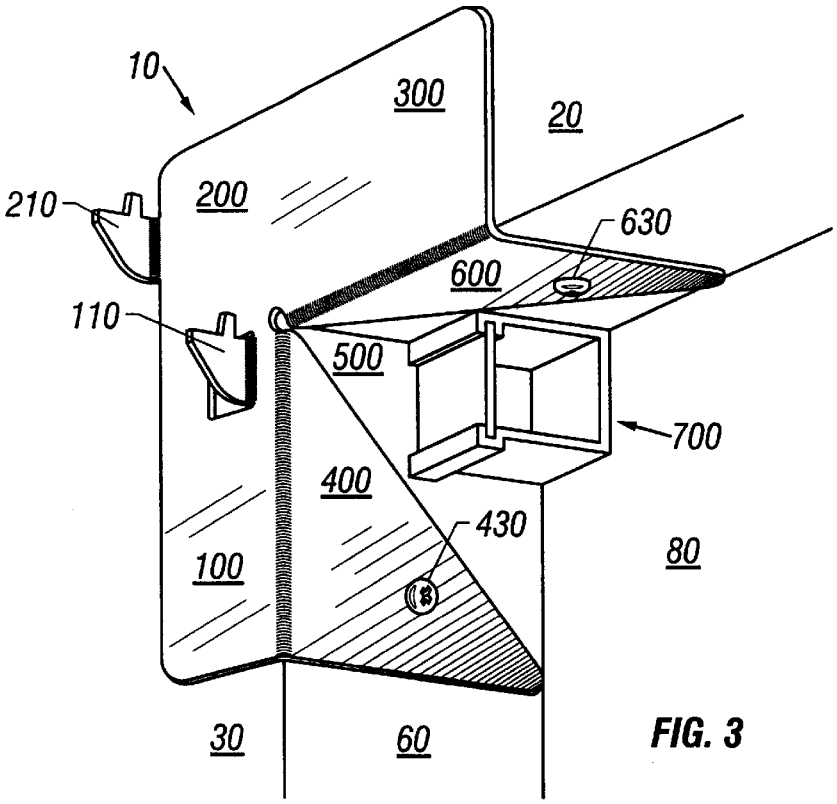
FIG. 3 is a perspective view of the window support bracket of FIG. 2 additionally comprising a venetian blind mounting box.

A preferred embodiment of the present invention is shown in FIGS. 1, 2 and 3. As shown in FIG. 1, the window support bracket, referenced generally as numeral 1, of the present invention is for use with a window casing, referenced generally as numeral 90. The window casing 90 is comprised of an exterior face having a top section 20, a left section 30 and a right section 40. The interior face of the window casing 90 comprises a top section 50, a left section 60 and a right section 70. The interior face sections 50, 60 and 70 are oriented substantially at a right angle to the respective exterior face sections 20, 30 and 40 and are recessed within the window casing 90. A window support bracket 1 is affixed to the upper left and right corners of the window casing 90 providing structural support for window coverings.

Figure 5:
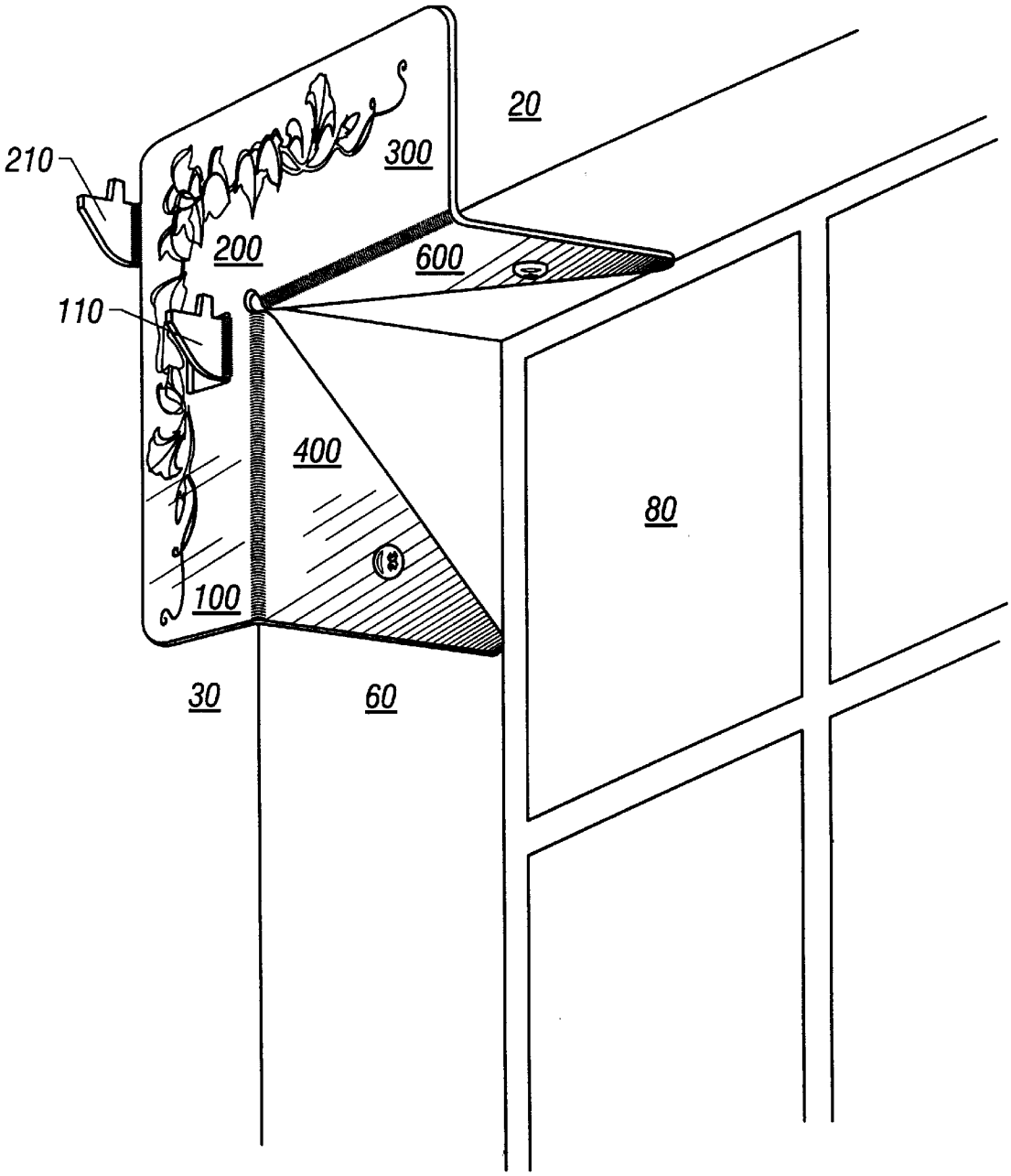
FIG. 5 is a perspective view of the preferred embodiment of FIG. 1 additionally comprising decorative ornamentation on the face plate.

A detailed perspective view of a support bracket 1 of the present invention is shown in FIG. 2. The description of the support bracket 1 affixed to the upper left corner of the window casing 90 is equally applicable to the support bracket 1 affixed to the opposite upper right corner of the window casing 90. The support bracket 1 affixed to the upper left corner of the window casing 90 and the support bracket 1 affixed to the upper right corner of the window casing 90 are mirror images of each other. The support bracket 1 comprises an L-shaped face plate, referenced generally as 10, comprising a vertical section 100, a corner section 200, and a horizontal section 300. As shown in FIG. 5, in an alternative embodiment of the present invention, the face plate sections 100, 200, and 300, comprise decorative ornamentation. Referring back to FIG. 2, in the preferred embodiment, the three sections 100, 200, and 300 of the face plate 10 engage the exterior face of the window casing 90 such that they sit flush with the top and left sections, 20 and 30, of the window casing 90. However, one skilled in the art would recognize that it is not necessary that a flush relationship exist between the face plate 10 and the exterior face of the window casing 90. For example, if the exterior face of the window casing 90 is lined with a window frame having decorative molding, the face plate 10 might not sit flush against the molding, however, the present invention would still function in its intended manner and such modifications are within the purview of the invention.

Figure 4:
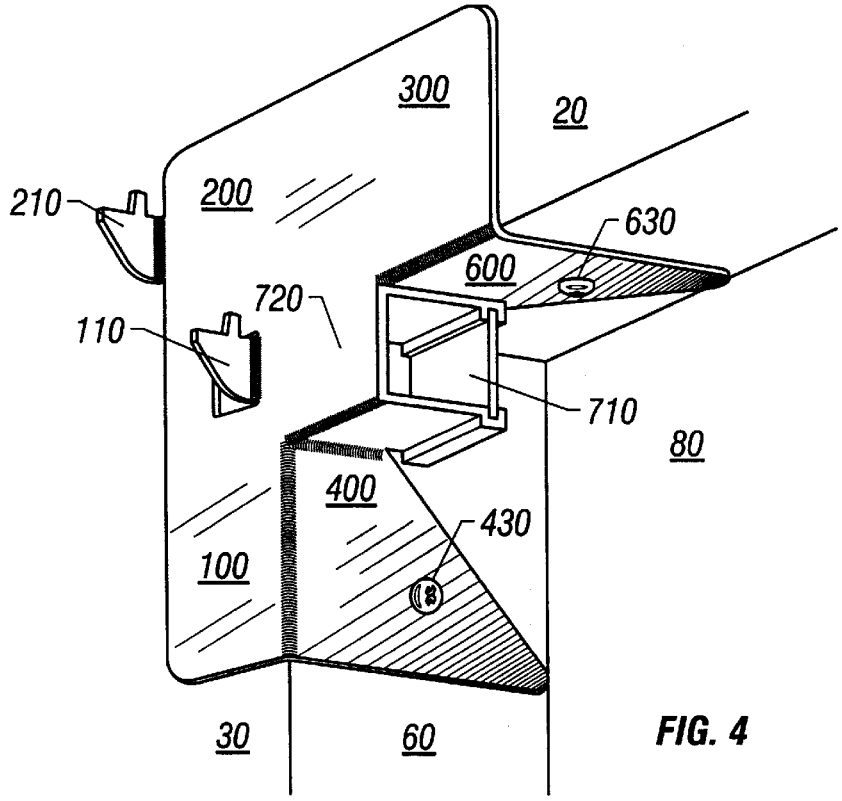
FIG. 4 is a perspective view of the window support bracket of FIG. 3 wherein the venetian blind mounting box is integral with the support bracket.

A mounting projection 110 is located along the vertical section 100 of the face plate 10. The mounting projection 110 is a structural plate projecting substantially perpendicularly away from the face plate 10. A securing element 112 is fixed to the mounting projection 110 to provide structural support for the window coverings. As best illustrated by FIGS. 4 and 5, in the preferred embodiment of the present invention, the securing element 112 is an upwardly extending protrusion which forms a notch 114 between the securing element 112 and the face plate 10. It should be noted that although the securing element 112 of the preferred embodiment of the present invention is an upwardly extending protrusion which interacts with a standard curtain or drapery rod, one skilled in the art would recognize that other securing elements are equally effective depending upon the type of window covering being secured to the window casing 90.

In the preferred embodiment, the mounting projection 110 located on the vertical section 100 of the face plate 10 is formed by die stamping a single metallic blank. Thus, in the preferred embodiment, there exists a projection aperture 116 created by the stamping process. However, one skilled in the art would recognize that the mounting projection 110 could be located along the edge 120 of the vertical section 100 of the face plate 10 which would extinguish the existence of the aperture 116. Further, one skilled in the art would also recognize that the mounting projection 110 could be created separately from the face plate 10 and affixed to the vertical section 100 of the face plate 10 by means such as welding, gluing, nailing, screwing, bolting, soldering, etc. Still further, one skilled in the art would recognize that the mounting projection 110 can be located anywhere along the vertical section 100 of the face plate 10 including the edge 120 of the face plate 10.

The corner section 200 of the face plate 10 joins the vertical section 100 and the horizontal section 300. In the preferred embodiment of the present invention, a mounting projection 210 is located along the edge 220 of the corner section 200. Similar to the mounting projection 110 discussed above, the mounting projection 210 is a structural plate projecting substantially perpendicularly away from the face plate 10. In the preferred embodiment of the present invention, the securing element 212 is an upwardly extending protrusion which forms a notch 214 between the securing element 212 and the face plate 10. As discussed above, although the securing element 212 of the preferred embodiment of the present invention is an upwardly extending protrusion, one skilled in the art would recognize that other securing elements are equally effective depending upon the type of window covering being secured to the window casing 90.

In the preferred embodiment of the support bracket 1, the mounting projection 210 is located on the edge 220 of the corner section 200 of the face plate 10. In this embodiment, the support bracket 1 is generally hidden from view by the drapery secured to the rod which is attached to the projection 210. However, one skilled in the art would recognize that the mounting projection 210 could be located anywhere along the corner section 200 of the face plate 10.

It should be noted, that although the preferred embodiment is described as having a mounting projection 110 located on the vertical section 100 of the face plate 10 for supporting a sheer rod and a mounting projection 210 located on the corner section 200 of the face plate 10 for supporting a drapery rod, the present invention is not limited to such locations or limited in the number of mounting projections. For example, one skilled in the art would recognize that depending upon the intended application of the support bracket 1, one or both of the mounting projections 110 and 210 may not be necessary. Further, it is fully conceivable that depending upon the application, both of the mounting projections 110, 210 may be located on the same section of the face plate 10. Still further, one skilled in the art would recognize that mounting projections could be located on the horizontal section 300 of the face plate 10. Thus, there are any number of alternative configurations for the mounting projections depending upon the type of application the support bracket 1 is being used for. All such modifications are intended to fall within the purview of Applicant's invention.

A vertical ear 400 extends perpendicularly from the vertical joint 130 of the vertical section 100 of the face plate 10. The vertical ear 400 consists of a perpendicular edge 410, an angled surface 420 and a securing device 430. The vertical ear 400 interacts with the left interior face 60 of the window casing 90. The vertical ear 400 is affixed to the left interior face 60 of the window casing 90 by use of the securing device 430. In the preferred embodiment of the support bracket 1, the securing device 430 is a hole for receipt of a screw therethrough. However, one skilled in the art would recognize that the vertical ear 400 can be affixed to the left interior face 60 by any number of means such as nails, bolts, glue, solder, staples, etc.

A horizontal ear 600 extends perpendicularly from the vertical joint 330 of the horizontal section 300 of the face plate 10. The horizontal ear 600 consists of a perpendicular edge 610, an angled surface 620 and a securing device 630. The horizontal ear 600 interacts with the top interior face 50 of the window casing 90. The horizontal ear 600 is affixed to the top interior face 50 by use of the securing device 630. In the preferred embodiment of the support bracket 1, the securing device 630 is a hole for receipt of a screw therethrough. However, one skilled in the art would recognize that the horizontal ear 600 can be affixed to the top interior face 50 by any number of means such as nails, bolts, glue, solder, staples, etc.

Between the angled surface 420 of the vertical ear 400 and the angled surface 620 of the horizontal ear 600, exists a gap 500. As shown in FIG. 3, the gap 500 is large enough to accommodate a venetian blind mounting box 700 in a corner of the interior face of the window casing 90. In an alternative embodiment, shown in FIG. 4, the venetian blind mounting box 700 is integral with the vertical ear 400 and the horizontal ear 600. One skilled in the art would recognize that the venetian blind mounting box 700 can be integral with both of the vertical ear 400 and the horizontal ear 600 conjunctively, or with either the vertical ear 400 or the horizontal ear 600 individually.

One skilled in the art would recognize that a typical venetian blind mounting box 700 is comprised of an open ended box. One of the five walls is typically a sliding removable panel necessary to facilitate insertion and support of the venetian blinds. In the particular embodiment shown in FIG. 4, the sliding removable panel 710 of the venetian blind mounting box 700 is located on the window side of the mounting box 700. The particular advantage of this panel 710 location is to place the forces and stresses resulting from the operation of the venetian blinds upon the integral outer surface 720 of the venetian blind box 700. Placing the forces and stresses on an integral outer surface 720 of the venetian blind box 700 as opposed to the sliding removable panel 720 results in a more stable support.

Figure 7:
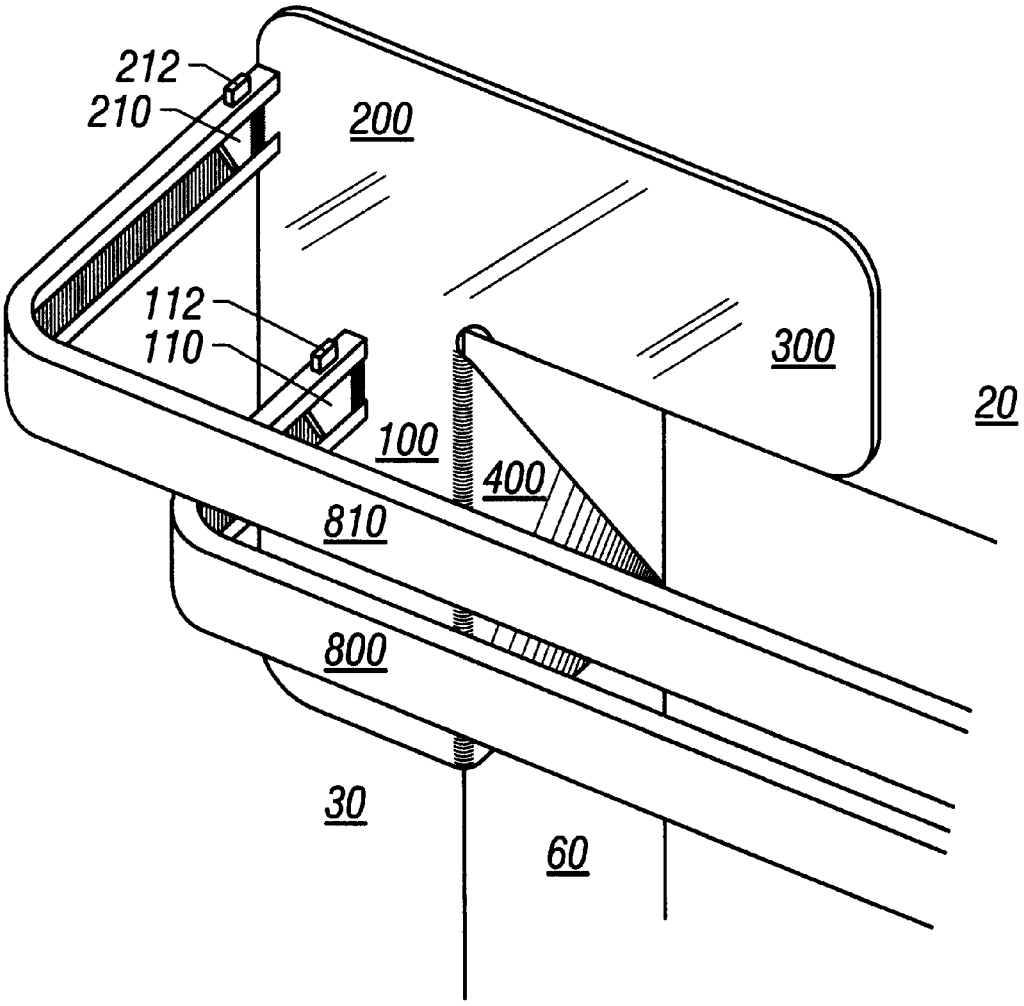
FIG. 7 is a perspective view of a drapery rod and a curtain rod secured to the mounting projections of the preferred embodiment of the window support brackets.

The method of use of the preferred embodiment of the present invention is best described with reference to FIG. 2. The support bracket 1 is positioned within the window casing 90 such that the vertical ear 400 is in contact with the left interior face 60 of the window casing 90. The support bracket 1 is slid upward along the left interior face until the horizontal ear 600 is in contact with the top interior face 50 of the window casing 90. The ears 400 and 600 are then affixed to their respective contact surfaces 60 and 50 by screws. The perpendicular orientation of the ears 400 and 600 automatically positions the support bracket 1 plumb with the corner of the window. Since the window casing 90 is usually the same height at each corner and the window support brackets 1 are plumb with each corner, the support brackets 1 are also self-leveling. Finally, the window coverings are secured to the mounting projections 110 or 210. As shown in FIG. 7, a curtain rod 800 and a drapery rod 810 are secured to mounting projections 110 and 210, respectively. Alternatively, or additionally, venetian blinds can be supported within the venetian blind mounting box 700, shown in FIG. 3.

Figure 6:
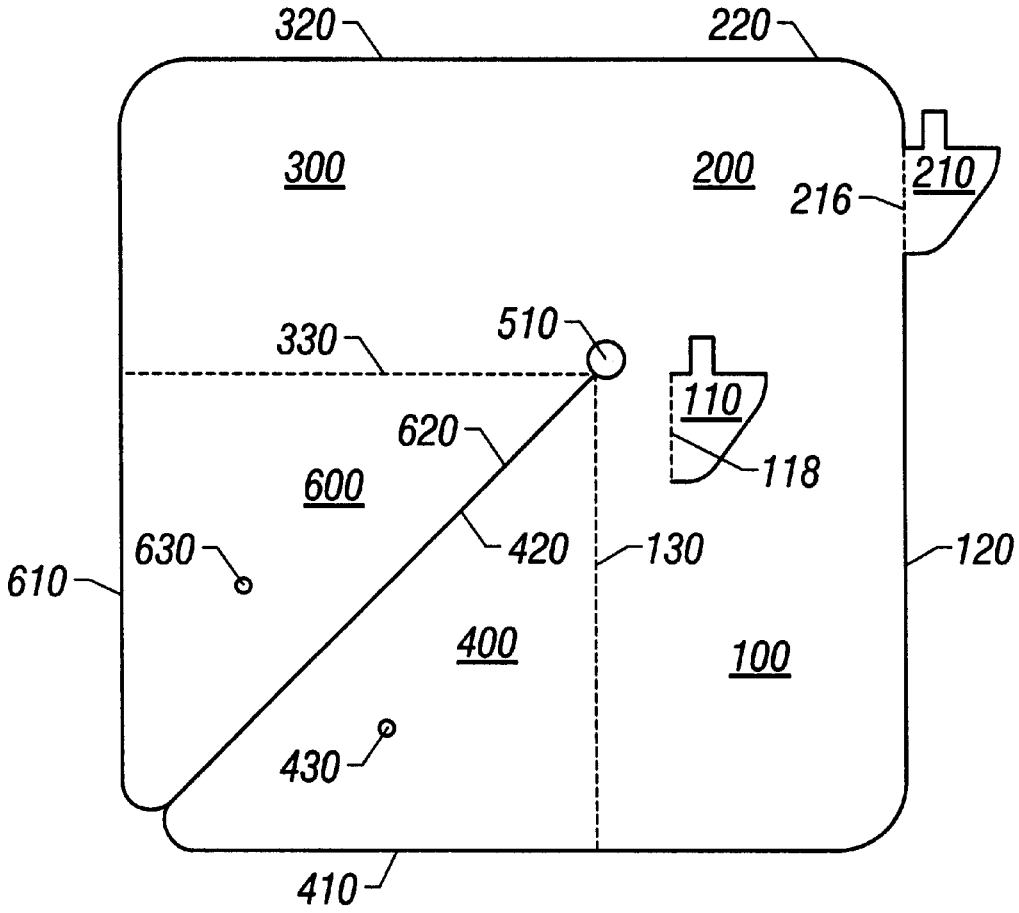
FIG. 6 is a top plan view of a metallic blank used in the die-stamp manufacture window support bracket of the present invention.

The method of manufacture of the preferred embodiment of the present invention is best described by reference to FIG. 6. The support bracket 1 of the present invention is created by die stamping a metallic blank, referenced generally as numeral 1000. The die stamping process first creates cuts within the blank 1000 along the angled surfaces 420 and 620 and also around the perimeter of the mounting projections 110 and 210. Additionally, the holes that comprise the securing devices 430 and 630 and the junction point 510 of the angled surfaces 420 and 620 are punched out of the blank 1000. Next, the vertical ear 400 is bent downward 90 degrees along the vertical joint 130 while the horizontal ear 600 is bent downward 90 degrees along the horizontal joint 330. Simultaneously, the mounting projections 110 and 210 are bent upward 90 degrees along joints 118 and 216, respectively. The result of the die stamp process is the preferred embodiment of the support bracket 1 of the present invention. Although the preferred embodiment is manufactured by die stamping a metallic blank 1000, one skilled in the art would recognize that the present invention can also be created just as easily by injection molding plastics, particularly when the venetian blind mounting box is integral with one or both of the vertical 400 and/or horizontal ears 600.

Although described in terms of the preferred embodiments shown in the figures, those skilled in the art who have the benefit of this disclosure will recognize that changes can be made to the individual component parts thereof which do not change the manner in which those components function to achieve their intended result. For instance, as discussed above, alternative shapes and positioning of the mounting projections 110 and 210 can be utilized to achieve the desired function. The mounting projections 110 and 210 only need to be able to support the desired window coverings to fall within the purview of Applicant's invention. All such changes are intended to fall within the scope of the following non-limiting claims.

What is claimed is:

1. A self-leveling window support bracket for use in supporting window coverings within a window casing, the window casing having an exterior face comprising a top section and left and right sections depending from either end of the top section and an interior face comprising top, left and right sections substantially at a right angle to the respective top, left and right sections of the exterior face, the window support bracket comprising:

an L-shaped face plate capable of engaging an exterior face of a window casing, the face plate comprising a vertical section, a horizontal section and a corner section joining the vertical and horizontal sections, the horizontal section further comprising an exterior edge and a horizontal joint, the vertical section further comprising a second exterior edge and a vertical joint;

a vertical ear extending perpendicularly from the vertical joint of the vertical face plate section for attachment against a right or left section of the interior face of the window casing;

a horizontal ear extending perpendicularly from the horizontal joint of the horizontal face plate section for attachment against the top section of the interior face of the window casing; and at least one curtain mounting projection mounted on the face plate.

2. The support bracket of claim 1 comprising decorative ornamentation on the L-shaped face plate.

3. The support bracket of claim 1 comprising a first curtain mounting projection mounted on the vertical section of the L-shaped face plate and a second curtain mounting projection mounted on the corner section of the L-shaped face plate.

4. The support bracket of claim 1 comprising holes formed through the ears for receiving fasteners therethrough.

5. The support bracket of claim 1 comprising a gap between the horizontal and vertical ears for mounting a venetian blind mounting box in a corner of the interior face of the window casing.

6. The support bracket of claim 1 comprising a venetian blind mounting disposed between the horizontal and vertical ears.

7. The support bracket of claim 6 wherein the venetian blind mounting is integral with the horizontal ear, vertical ear or both of the horizontal and vertical ears.

8. The support bracket of claim 7 wherein the venetian blind mounting box comprises an outer surface nearest the exterior face and integral with the mounting box and a sliding removable panel remote from the exterior face of the window casing.

9. The support bracket of claim 1 wherein the bracket is die stamped from a metallic blank.

10. The support bracket of claim 1 wherein the bracket is made of injection molded plastic.

11. A method for supporting window coverings within a window casing, comprising the steps of:

positioning a pair of the support brackets of claim 1 within the window casing such that the vertical ears are in contact with the second side sections of the interior face;

positioning the support brackets along the second side sections of the interior face with the horizontal ears in contact the second top section of the interior face;

affixing the horizontal ears to the second top section of the interior face of the window casing and affixing the vertical ears to the second side section of the interior face of the window casing;

mounting the window coverings to the mounting projections.

* * * * *